US011371396B2

(12) United States Patent
Hollweck et al.

(10) Patent No.: US 11,371,396 B2
(45) Date of Patent: Jun. 28, 2022

(54) SWITCHABLE ACTUATION DEVICE FOR A POPPET VALVE IN AN INTERNAL COMBUSTION ENGINE, INTERNAL COMBUSTION ENGINE AND MOTOR VEHICLE

(71) Applicant: MAN Truck & Bus SE, Munich (DE)

(72) Inventors: Johannes Hollweck, Sulzbach-Rosenberg (DE); Thorsten Bachmann, Fürth (DE)

(73) Assignee: MAN TRUCK & BUS SE, Munich (DE)

( * ) Notice: Subject to any disclaimer, the term of this patent is extended or adjusted under 35 U.S.C. 154(b) by 0 days.

(21) Appl. No.: 17/416,443

(22) PCT Filed: Dec. 12, 2019

(86) PCT No.: PCT/EP2019/084778

§ 371 (c)(1),
(2) Date: Jun. 18, 2021

(87) PCT Pub. No.: WO2020/126775

PCT Pub. Date: Jun. 25, 2020

(65) Prior Publication Data

US 2022/0074321 A1 Mar. 10, 2022

(30) Foreign Application Priority Data

Dec. 19, 2018 (DE) ..... 10 2018 132 857.5

(51) Int. Cl.
*F01L 1/18* (2006.01)
*F01L 13/00* (2006.01)
*F01L 1/053* (2006.01)

(52) U.S. Cl.
CPC ..... *F01L 1/181* (2013.01); *F01L 1/053* (2013.01); *F01L 13/0005* (2013.01);
(Continued)

(58) Field of Classification Search
CPC ..... F01L 1/181; F01L 1/053; F01L 13/0005; F01L 2001/186; F01L 2013/101; F01L 2013/105; F01L 2013/106; F01L 2305/00
See application file for complete search history.

(56) References Cited

U.S. PATENT DOCUMENTS 4,252,093 A 2/1981 Hazelrigg
5,553,584 A * 9/1996 Konno ..... F01L 1/267 123/90.16

(Continued)

FOREIGN PATENT DOCUMENTS

AT 511050 A1 8/2012
DE 4142197 A1 4/1993

(Continued)

OTHER PUBLICATIONS

German search report issued in German Patent Application No. DE102018132857.5 dated Jul. 30, 2019. English translation not available.

(Continued)

*Primary Examiner* — Zelalem Eshete
(74) *Attorney, Agent, or Firm* — Weber Rosselli & Cannon LLP

(57) ABSTRACT

The present invention relates to a switchable actuation device (100) for a gas exchange valve. The switchable actuation device (100) comprises a two-piece rocker arm (10). Said rocker arm comprises a first rocker arm portion (1*a*), which is mounted pivotably about a rocker arm shaft (2) and to which a bearing sleeve (1*a*1) is fastened concentrically with the rocker arm shaft (2), and a second rocker arm portion (1*b*) mounted pivotably on the bearing sleeve (1*a*1). Furthermore, both the first and the second rocker arm portions (1*a*, 1*b*) each comprise a cut-out (3*a*, 3*b*), wherein a locking element (4*a*) of a coupling device (4) of the switchable actuation device (100) can optionally be brought into and out of engagement with the two cut-outs (3*a*, 3*b*). An actuation of the poppet valve, preferably a change between a closed position and an open position of the poppet valve, is interrupted if the locking element (4*a*) is not in engagement with the two cut-outs (3*a*, 3*b*). The invention (Continued)

Figure 1:
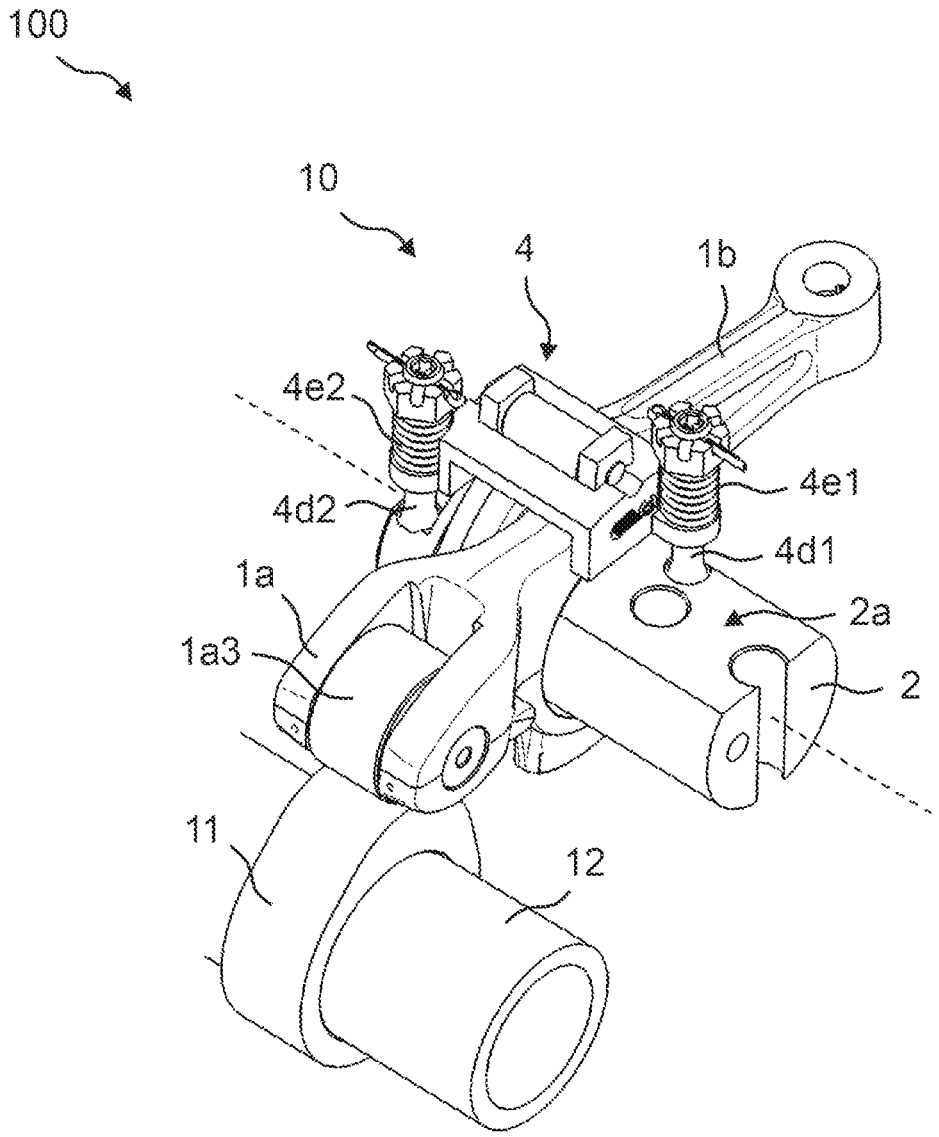

also relates to an internal combustion engine (20) and a motor vehicle (30).

18 Claims, 6 Drawing Sheets

(52) U.S. Cl.
CPC ... *F01L 2001/186* (2013.01); *F01L 2013/101* (2013.01); *F01L 2013/105* (2013.01); *F01L 2013/106* (2013.01); *F01L 2305/00* (2020.05)

(56) References Cited

U.S. PATENT DOCUMENTS

| | | | |
|---|---|---|---|
| 2007/0193543 | A1 | 8/2007 | Best |
| 2017/0284237 | A1 | 10/2017 | Shewell |

FOREIGN PATENT DOCUMENTS

| | | | |
|---|---|---|---|
| DE | 102015015087 | A1 | 5/2017 |
| EP | 1878883 | A1 | 1/2008 |
| FR | 2990465 | A1 | 11/2013 |
| JP | S60259715 | A | 12/1985 |
| JP | S6284603 | U | 5/1987 |
| JP | H0996206 | A | 4/1997 |

OTHER PUBLICATIONS

International Search Report and Written Opinion issued in PCT/EP2019/084778 dated Feb. 25, 2020 English translation not available.

German Office Action issued in German Patent Application No. 102018132857.5 dated Feb. 9, 2022. English translation not available.

* cited by examiner

SWITCHABLE ACTUATION DEVICE FOR A POPPET VALVE IN AN INTERNAL COMBUSTION ENGINE, INTERNAL COMBUSTION ENGINE AND MOTOR VEHICLE

CROSS-REFERENCE TO RELATED APPLICATIONS

This application is a 371 application of PCT/EP2019/084778 filed Dec. 12, 2019, which claims benefit of and priority to German Patent Application Serial No. DE102018132857.5 filed Dec. 19, 2018, the disclosures of the above-identified applications are hereby incorporated by reference in their entirety.

The present invention concerns a switchable actuation device for a poppet valve in an internal combustion engine. In particular, the invention concerns a switchable actuation device for a gas exchange valve of an internal combustion engine, which valve is movable indirectly and periodically via a cam of a camshaft between a closed and an open position. The invention furthermore also concerns an internal combustion engine and a motor vehicle with such an actuation device.

In internal combustion engines, in situations in which there is no requirement for the full drive moment of the internal combustion engine, the fuel consumption of the internal combustion engine may be lowered by deactivating the injection of individual cylinders. If in addition the gas exchange is also deactivated in the corresponding cylinders, the fuel consumption may be lowered even further since no gas exchange work need be performed. At the same time, because the gas exchange is deactivated, the cooling of the exhaust gas aftertreatment system, in particular in low load operation, is reduced.

In order now to allow such targeted deactivation of the gas exchange of individual cylinders, in the prior art, various systems are known with combinations of rocker arms or cam followers. The disadvantage of the known systems however is often that high loads occur on the bearings or individual components, or many or large components must be moved for deactivation or activation.

It is therefore an object of the invention to provide a solution for targeted deactivation of the gas exchange of individual cylinders of an internal combustion engine, which is improved in comparison with the prior art. In particular, the invention is based on the object of providing a switchable (disengageable) actuation device for a poppet valve in an internal combustion engine which can be implemented with components that are subjected to low loads, i.e. in particular, are not loaded by moments.

These objects are achieved according to the invention by a switchable actuation device, an internal combustion engine and a motor vehicle with the features of the independent claims. Advantageous embodiments and applications of the invention are the subject of the dependent claims and are explained in more detail in the description which follows, with partial reference to the figures.

The switchable actuation device according to the invention for a poppet valve in an internal combustion engine comprises a two-piece rocker arm for actuating the poppet valve. This comprises a first rocker arm portion, which is mounted pivotably about a rocker arm shaft and on which a bearing sleeve, preferably formed as a hollow cylinder, is attached concentrically with the rocker arm shaft. Furthermore, the two-piece rocker arm comprises a second rocker arm portion which is mounted pivotably on the bearing sleeve. In other words, the bearing sleeve attached to the first rocker arm portion may thus serve as a plain bearing for the second rocker arm portion. Furthermore, both the first and the second rocker arm portions each comprise a cutout, preferably in the form of a groove extending parallel to the rocker arm shaft. In order to better distinguish between the two cutouts, in the text below the cutout of the first rocker arm portion is described as the "first" cutout, and the cutout of the second rocker arm portion is described as the "second" cutout.

In addition to the two-piece rocker arm, the switchable actuation device furthermore comprises a coupling device for releasable, rotationally fixed connection of the first and second rocker arm portions. For this, the coupling device comprises a locking element—e.g. in the form of an insert wedge—which may be brought optionally into and out of engagement with the first and second cutouts. Preferably, the engagement between the locking element and the first or second cutout is a tongue-and-groove engagement and/or a form-fit and/or force-fit engagement. Here, actuation of the poppet valve, preferably a change between a closed and an open position of the poppet valve, is interrupted if the locking element is not in engagement with the first or second cutout. In other words, the two-piece rocker arm may be present firstly in a coupled state, in which the two rocker arm portions are connected together rotationally fixedly and act as a single, two-sided, complete rocker arm in order to allow a gas exchange at the poppet valve. Secondly, the two-piece rocker arm may be present in a decoupled state, in which the two rocker arm portions can be pivoted independently of each other and act as two separate one-sided arms in order to interrupt a gas exchange at the poppet valve. The change from the coupled to the decoupled state and vice versa takes place by movement of the locking element.

As a whole, thereby a switchable (disengageable) actuation device is provided for a poppet valve in which, because of the nature of the coupling and the mounting of the two rocker arm portions according to the invention, the rocker arm is guided with low load and hence little wear, wherein the occurrence of moments on the bearing and components can be largely avoided.

Preferably, the poppet valve of the internal combustion engine is a gas exchange valve which can be moved indirectly and periodically by a cam of a camshaft between a closed and an open position. For example, here the first rocker arm portion may be actively connected to a cam of the camshaft via a roller which is mounted rotatably on the first rocker arm portion, and the second rocker arm portion may be coupled to the poppet valve or gas exchange valve for motion transmission. This assignment of the first and second rocker arm portions to a cam or a valve may however also be reversed. In other words, the first rocker arm portion mounted pivotably about the rocker arm shaft may be either a cam lever or a valve lever, wherein then the second rocker arm portion mounted pivotably on the bearing sleeve may accordingly be configured as the other lever type (valve lever or cam lever).

According to a first aspect of the invention, the bearing sleeve may be formed integrally on the first rocker arm portion. In other words, the bearing sleeve and the first rocker arm portion may be configured as one piece. In this way, advantageously, production and installation may be simplified. Additionally or alternatively, the bearing sleeve may also surround the rocker arm shaft concentrically. In other words, the bearing sleeve may completely surround the rocker arm shaft circumferentially. Particularly preferably, the bearing sleeve is here configured as a hollow cylinder, the inner radius of which substantially corresponds to the outer radius of the rocker arm shaft. Advantageously, thereby a large contact area can be achieved between the bearing sleeve and the rocker arm shaft, which improves the stability of the bearing. In order to further reduce the friction between the rocker arm shaft and the first rocker arm portion which is mounted pivotably about the rocker arm shaft, the first rocker arm portion and the bearing sleeve may also be arranged on a common plain bearing bush about the rocker arm shaft. Additionally or alternatively, the bearing sleeve may also comprise a groove running preferably circumferentially, i.e. perpendicularly to the rocker arm shaft. A locking ring may be inserted herein for securing the axial position of the second rocker arm portion. Advantageously, this suppresses an axial movement of the second rocker arm portion and thereby achieves a more stable rocker arm guidance. Preferably, in addition, a thrust washer surrounding the bearing sleeve is provided between the locking ring and the second rocker arm portion, for reducing the friction.

According to a further aspect of the invention, by a movement perpendicularly to the rocker arm shaft, preferably by a substantially radial movement, the locking element may be brought optionally into a release position $S_e$ or a locking position $S_a$. For this, the coupling device may be configured to move the locking element perpendicularly to the rocker arm shaft for releasable, rotationally fixed connection of the first and second rocker arm portions, so that the locking element may be brought optionally into a release position $S_e$ or a locking position $S_a$. In the release position $S_e$, the locking element is not in engagement with the first and second cutouts. Whereas in the locking position $S_a$, the locking element is in engagement with the first and second cutouts. The expression "in engagement" may be generally understood as an intermeshing of the components and/or an insertion of the locking element in the first and second cutouts. Preferably, if the locking element is in engagement with the first and second cutouts, a force-fit and/or form-fit connection is created between the locking element and the first cutout, and between the locking element and the second cutout. Particularly preferably, the locking element is connected to the first and second cutouts by force fit in the radial and axial directions and by form fit in the circumferential direction. Here and in the document below, such directional indications (radial, axial, circumferential) should be understood in relation to the rocker arm shaft. Thus for example the expression "in the circumferential direction" may be understood as an abbreviation for "in the circumferential direction of the rocker arm shaft" or "in the circumferential direction relative to the rocker arm shaft". Because locking or release of the locking takes place by movement of the locking element perpendicularly relative to the rocker arm shaft, advantageously loads on the bearing and components may be avoided, since here forces but no moments occur on the bearings and components.

According to a further aspect of the invention, the first and second cutouts may each be formed as a groove extending parallel to the rocker arm shaft, with a groove cross-section which tapers towards the rocker arm shaft, e.g. in the form of a trapezoid groove. The expression "groove cross-section" here designates a section through the first or second cutout perpendicularly to the rocker arm shaft. In other words, a circumferential extent of the groove lying radially outwardly relative to the rocker arm shaft may be greater than a circumferential extent of the groove lying radially further inward. Furthermore, the locking element may be formed wedge-shaped and/or frustoconical and/or at least in portions complementary in shape to the first and/or second cutout. Preferably, the contact faces between the locking element and the first and second cutouts here run parallel to the rocker arm shaft. Advantageously, thus a form-fit connection may be created in the circumferential direction between the locking element and the first and/or second cutout, whereby a stable locking of the two rocker arm portions is achieved. In addition, also the introduction or insertion of the locking element in the first and second cutouts may thereby be facilitated.

In order to further improve the locking in this context, according to a refinement of this aspect, each of the groove cross-sections may be configured to clamp the locking element in self-locking fashion in the circumferential direction on engagement of the locking element in the first and second cutouts. In other words, the seat of the locking element in the first and second cutouts may be designed so as to prevent an undesired autonomous release of the connection between the locking element and the first and second cutouts with respect to movements in the circumferential direction. The actual design of the groove cross-section which leads to such a self-locking clamping of the locking element may be established by the person skilled in the art by simple testing of various groove cross-sections. Advantageously, the self-locking as a whole increases the operating reliability of the actuation device.

According to a further aspect of the invention, each of the groove cross-sections may be delimited towards the rocker arm shaft, i.e. in the direction of the rocker arm shaft, by a groove base and at the sides by two groove flanks. Here, a slope angle $\alpha$ of the groove flanks may be smaller than the self-locking angle $\alpha_h$ of the material pairing of the first rocker arm portion and the locking element, and/or smaller than the self-locking angle $\alpha_h$ of the material pairing of the second rocker arm portion and the locking element. The slope angle $\alpha$ here designates the angular deviation of the groove flanks from an ideal rectangular cross-section (see also FIG. 5). Furthermore, both groove flanks may have the same or different slope angles $\alpha$. Furthermore, depending on the material pairing, the self-locking angle $\alpha_h$ may be determined via the arc tangent of the static friction coefficient $\mu$ between the two components ($\alpha_h < 2.\arctan(\mu)$) or by experiment. In the case preferred here of the material pairing of oiled iron surfaces, the slope angle of the groove flanks is thus less than 11.4°. Advantageously, thereby a fixing of the locking element in the circumferential direction which is simple to implement may be ensured.

According to a further aspect of the invention, the locking element may have its greatest extent along the rocker arm shaft. In other words, the locking element may thus have a greater length in the axial direction than in the radial direction or circumferential direction. For as large as possible a contact area between the locking element and the first and second cutouts, particularly preferably, the locking element in the axial direction may have the same length as the first and second cutouts. Also or alternatively, the locking element may also extend preferably substantially parallel to the rocker arm shaft. For example, for this the locking element may be formed as a rod and/or bar. Advantageously, this feature allows a stable and rotationally fixed connection of the two rocker arm portions. Additionally or alternatively, the locking element may be movable only perpendicularly to the rocker arm shaft. In other words, the locking element may be movable exclusively in the radial direction for being brought into and out of engagement with the first and second cutouts. In this way, advantageously, a reliable and simple coupling or decoupling of the two rocker arm portions is possible.

According to a further aspect of the invention, the coupling device may furthermore also comprise a bearing block for axially fixing the locking element. Here, the bearing block may have two bearing cheeks which are spaced apart in the axial direction and on which the locking element may be pivotably mounted by means of two pegs attached to the locking element. Preferably, the bearing cheeks for this comprise bushes, particularly preferably bushes with slots for receiving the pegs. Advantageously, thus a reliable mounting of the locking element may be achieved.

In order to facilitate insertion of the locking element in the first and second cutouts, according to a further aspect of the invention, the pegs of the locking element may each be guided in a slot of the bearing cheeks of the bearing block which extends in the circumferential direction. In other words, the bearing cheeks may each comprise bushes with slots extending in the circumferential direction, in which the pegs of the locking element are movably mounted. Thus as well as a pivot movement of the locking element about the pegs, additionally also a movement of the locking element in the circumferential direction is possible, whereby seizing of the two rocker arm portions during locking may be avoided.

According to a further aspect of the invention, the bearing block may furthermore also comprise a guide roller which is mounted so as to be rotatable in the axial direction and which may rest on the locking element in the radial direction for radially fixing the locking element. Preferably, the rotatably mounted guide roller may here roll on an outer face of the locking element. In this way advantageously, in the locked state, an optimal radial force transfer for locking the locking element may be ensured at any time or in any pivot position.

In order to hold the bearing block itself, according to a further aspect of the invention, the coupling device may also comprise at least one slide pin which is arranged on the rocker arm shaft and on which the bearing block is mounted so as to be displaceable radially relative to the rocker arm shaft. In addition or alternatively, the coupling device may also comprise at least one slide rail which is arranged on the rocker arm shaft and on which the bearing block is mounted so as to be displaceable radially relative to the rocker arm shaft. Both variants advantageously allow radial guidance of the bearing block in a manner which is simple to implement, in order thus to ensure a reliable change between the release position $S_e$ and the locking position $S_a$. Instead of the one or more slide pins and/or slide rails being arranged on or attached to the rocker arm shaft, these may also be attached at other locations. Thus the coupling device may additionally or alternatively comprise also at least one slide pin which is arranged on the cylinder head or on a protrusion and/or a bracket of the cylinder head, and on which the bearing block is mounted so as to be displaceable relative to the rocker arm shaft. In addition or alternatively, the slide pin may also be configured as a slide rail.

In order to ensure an adequate radial fixing of the locking element, according to a further aspect of the invention, the coupling device may furthermore comprise a clamping device, by means of which the bearing block can be clamped in the radial direction against the first and second cutouts. For example, for this the clamping device may comprise one or more spring elements (e.g. coil springs). Here, the clamping device may furthermore be configured to clamp the bearing block and hence the locking element against the rocker arm shaft, and hence against the first and second cutouts, more strongly when the locking element does not engage or lie in the first and/or second cutout than when the locking element does engage or lie in the first and/or second cutout. In other words, the clamping device may be configured to adapt the clamping force on the bearing block and/or locking element depending on its/their radial distance from the rocker arm shaft. Advantageously, thereby a secure radial fixing of the locking element is possible.

In order to allow a rapid and simple change between the locked and released state of the two-part rocker arm, according to a further aspect of the invention, the actuation device may comprise a switch device, by means of which the locking element can be actuated so as to be brought optionally into and out of engagement with the first and second cutouts. In other words, the switch device may be configured to bring the locking element into engagement with the first and second cutouts for rotationally fixed connection of the first and second rocker arm portions, and to bring the locking element out of engagement with the first and second cutouts in order to release the rotationally fixed connection of the first and second rocker arm portions. This switch device may here be an electromagnetic and/or pneumatic and/or hydraulic switch device. For example, the switch device may comprise a permanent magnet material attached to the bearing block and an electromagnet arranged adjacent thereto, wherein the permanent magnet material cooperates magnetically with the electromagnet for switching the locking element. In addition or alternatively, the switch device may also comprise a piston-cylinder arrangement attached to the bearing block, wherein the cylinder is loaded with a hydraulic medium for switching the locking element. Preferably, the switch device is configured such that the locking element is in engagement with the first and second cutouts when the switch device is in the deactivated state, and is not in engagement with the first and second cutouts when the switch device is in an activated state. In this way, advantageously, security against failure may be increased since operation of the poppet valve remains possible in the event of a fault in the switch device (fail-safe).

According to a further aspect of the invention, furthermore an internal combustion engine is provided, preferably a diesel internal combustion engine. The internal combustion engine here comprises a poppet valve with a switchable actuation device as described in this document. Furthermore, the internal combustion engine may also comprise several i.e. at least two poppet valves, each with a corresponding switchable actuation device. Advantageously, in this way as a whole, an internal combustion engine is provided in which the gas exchange of individual poppet valves can be deactivated in targeted fashion, preferably in low load operation.

The invention furthermore concerns a motor vehicle comprising an above-mentioned internal combustion engine, i.e. an internal combustion engine having a poppet valve with a switchable actuation device as described in this document. Preferably, the motor vehicle is a utility vehicle. In other words, the motor vehicle may be a motor vehicle which, because of its design and equipment, is configured for transporting persons or goods or for towing trailer vehicles. For example, the motor vehicle may be a truck, a bus and/or a semitrailer. In this context, however, it is immediately evident to the person skilled in the art that the internal combustion engine according to the invention may also be used in other types of vehicles, so protection is also claimed for other types of vehicles which comprise such an internal combustion engine with a switchable actuation device for a poppet valve. In particular, according to the invention, thus also a rail vehicle, preferably a motive power unit, an aircraft, preferably an airplane, and a ship are provided. The features disclosed in connection with the motor vehicle are also disclosed for the rail vehicle and the aircraft, and hence may also be claimed in particular independently of the motor vehicle.

Figure 2:
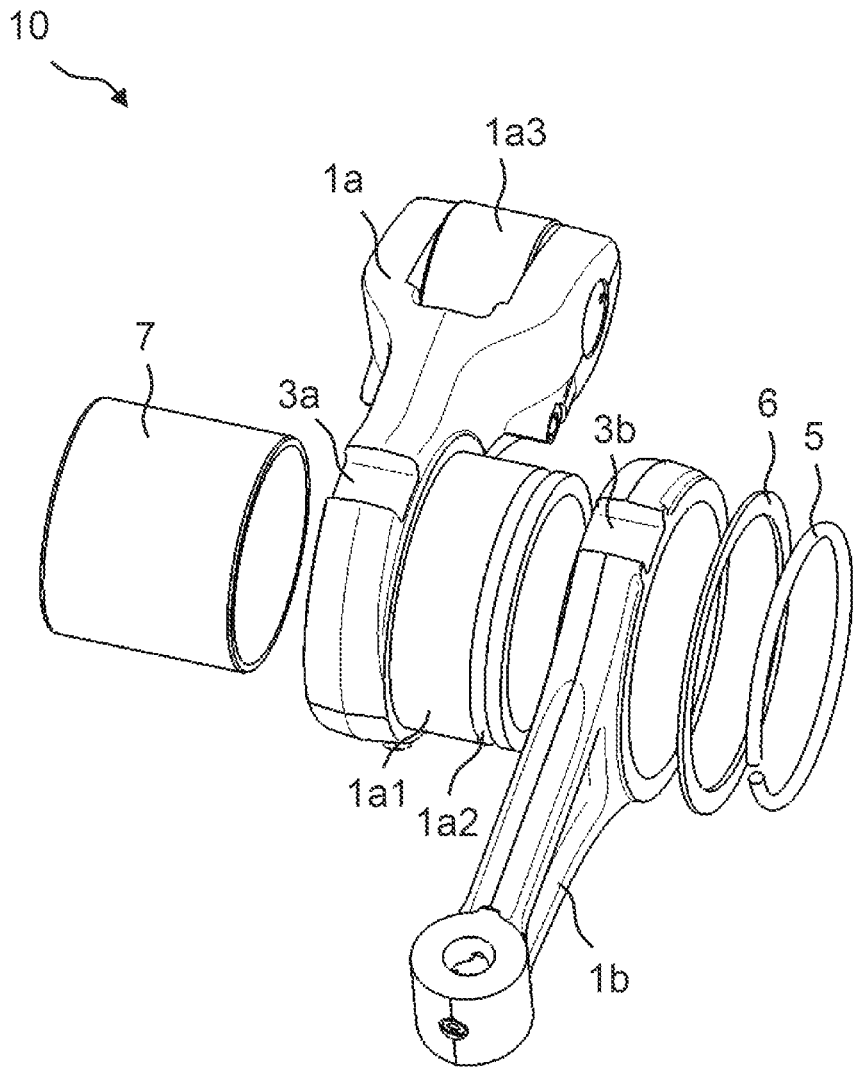
Figure 3:
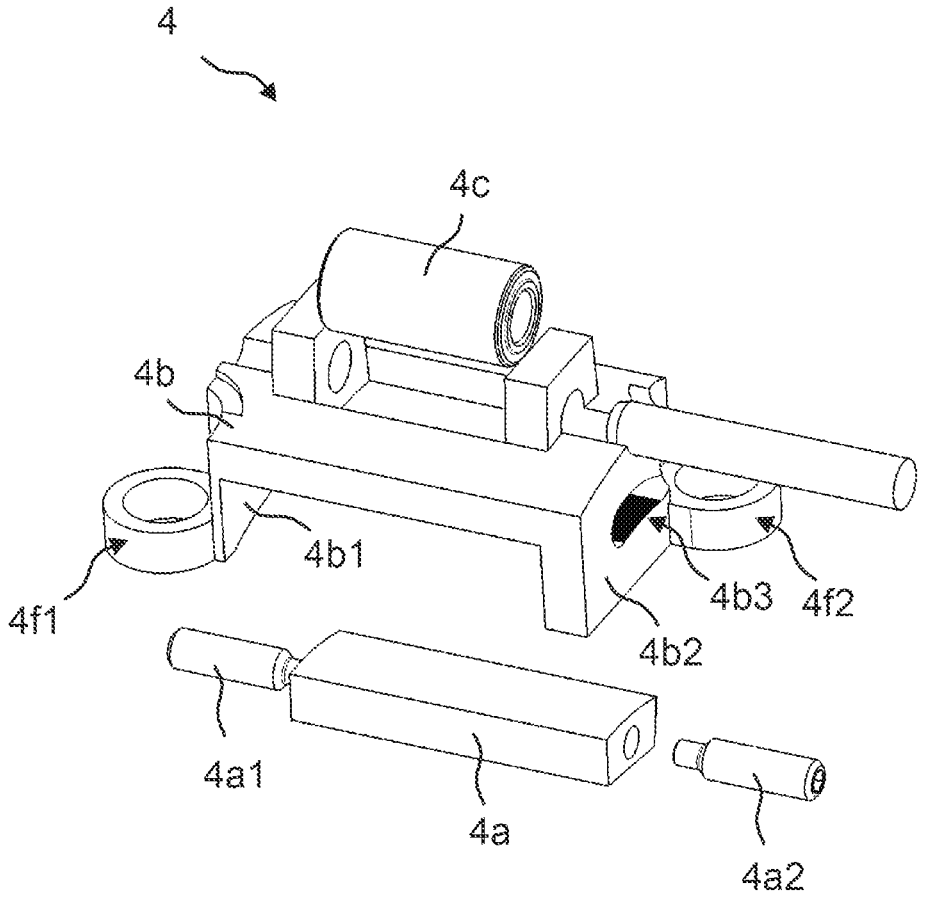
Figure 4:
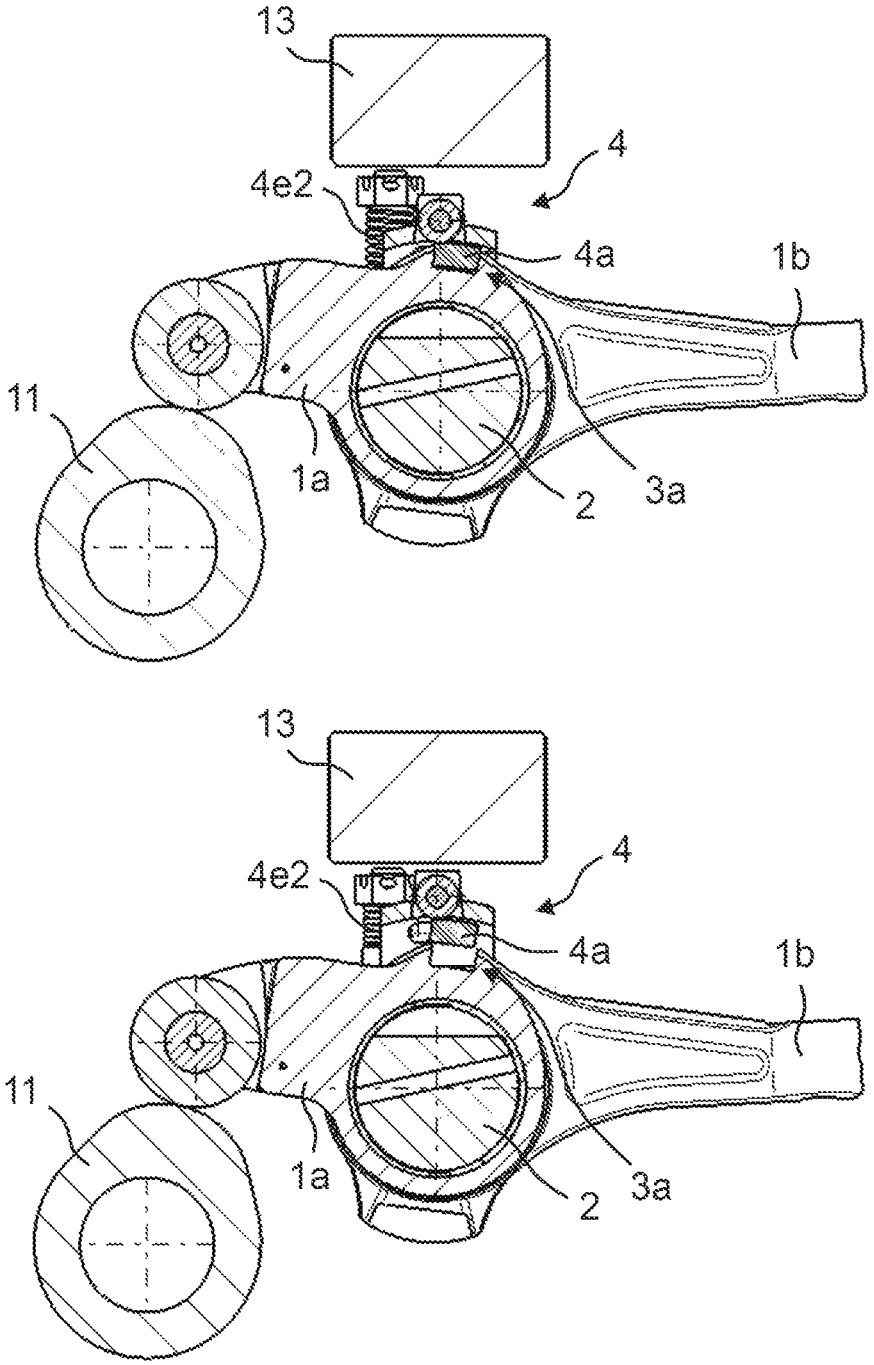
Figure 5:
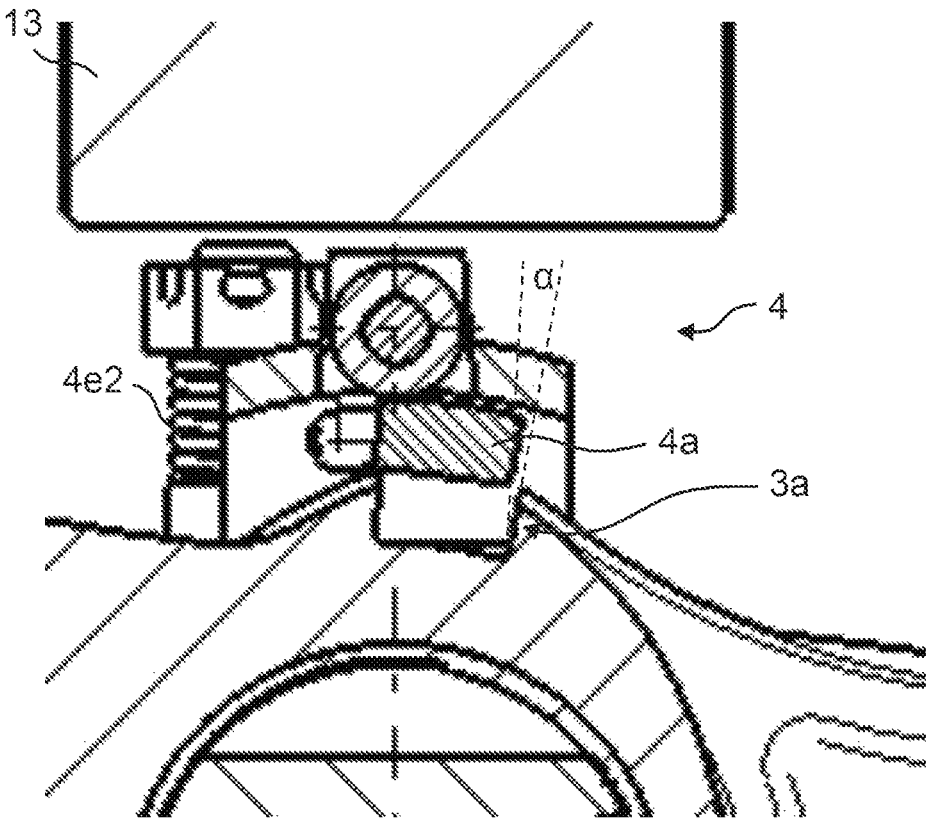
Figure 6:
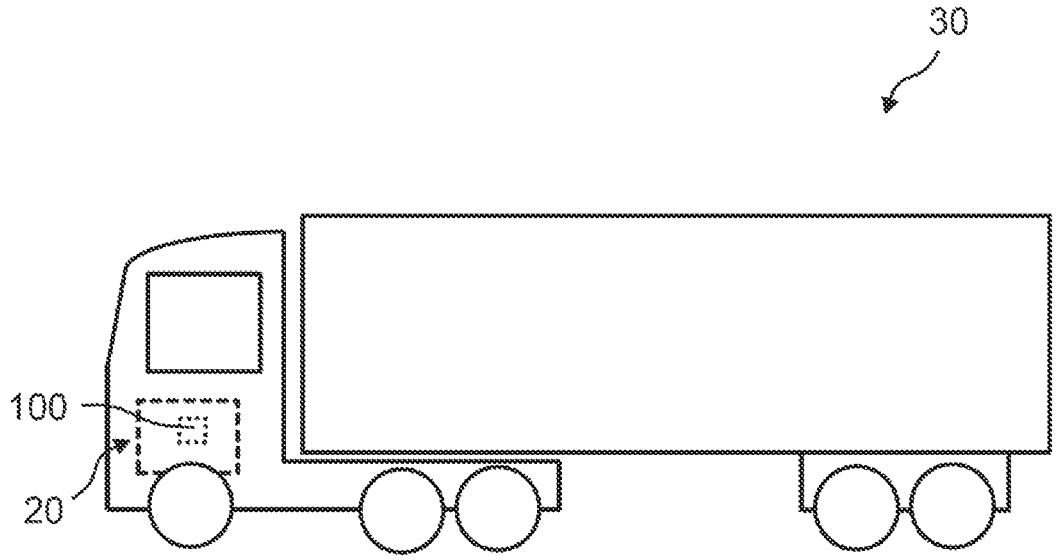

The aspects and features of the invention described above may be combined with each other in arbitrary fashion. Further details and advantages of the invention are described below with reference to the appended drawings. The drawings show:

FIG. 1: a diagrammatic depiction of a switchable actuation device for a poppet valve in an internal combustion engine according to an embodiment of the invention;

FIG. 2: an exploded diagrammatic depiction of a two-piece rocker arm of the switchable actuation device according to an embodiment of the invention;

FIG. 3: an exploded diagrammatic depiction of a coupling device of the switchable actuation device according to an embodiment of the invention;

FIG. 4: a diagrammatic side view of the switchable actuation device according to FIG. 1 in a locking position $S_a$ and a release position $S_e$;

FIG. 5: an enlarged detail view of FIG. 4 to illustrate the slope angle of the groove flanks; and FIG. 6: a motor vehicle comprising an internal combustion engine with a switchable actuation device according to an embodiment of the invention.

The same or functionally equivalent elements are designated with the same reference signs in all figures and in some cases are not described separately.

FIG. 1 shows a diagrammatic depiction of a switchable actuation device 100 for a poppet valve in an internal combustion engine 20 according to an embodiment of the invention. The actuation device 100 here comprises a two-piece rocker arm 10 for actuating the poppet valve (not shown in detail). The two-piece rocker arm 10 for this has a first rocker arm portion 1*a* which is mounted pivotably about a rocker arm shaft 2, i.e. rotatably through a specific angular range about the rocker arm shaft 2. A preferably hollow cylindrical bearing sleeve 1*a*1 is attached to this first rocker arm portion 1*a* concentrically with the rocker arm shaft 2, and in turn a second lever arm portion 1*b* is mounted pivotably thereon. In the mounted state shown in FIG. 1, the bearing sleeve 1*a*1 is not however visible (see FIG. 2), so here the two rocker arm portions 1*a* and 1*b* appear to be mounted next to each other on the rocker arm shaft 2. The feature used in this context, that the bearing sleeve 1*a*1 is attached "concentrically" with the rocker arm shaft 2, here means that the bearing shaft 1*a*1 and the rocker arm shaft 2 are arranged about a common center axis (dotted line in FIG. 1) such that the first rocker arm portion 1*a* and the second rocker arm portion 1*b* mounted on the bearing sleeve 1*a*1 are pivotable about this common center axis. In other words, the term "concentric" in this context may also mean "coaxial". Concentric here does not however mean that the bearing sleeve 1*a*1 necessarily completely surrounds the rocker arm shaft 2, but this is however possible.

The first rocker arm portion 1*a* may here, as shown, be actively connected to a cam 11 of the camshaft 12 via a roller 1*a*3 which is rotatably mounted on the first rocker arm portion 1*a*. In other words, the first rocker arm portion 1*a* may be set in motion, in particular in a pivot movement about the rocker arm shaft 2, by a periodic movement of the cam 11 during rotation of the camshaft 12. This movement of the first rocker arm portion 1*a* may or may not be optionally transmitted to the second rocker arm portion 1*b* by means of a coupling device 4 (described in more detail below). For this, the coupling device 4 is configured to optionally connect the two rocker arm portions 1*a*, 1*b* releasably together in a rotationally fixed fashion. In other words, the first and second rocker arm portions 1*a* and 1*b* may be coupled together by means of the coupling device 4 for motion transmission. The second rocker arm portion 1*b* may here be actively connected to the poppet valve, preferably a gas exchange valve, so that in the coupled state of the two rocker arm portions 1*a*, 1*b*, the poppet valve can be moved indirectly and periodically by means of a cam 11 of the camshaft 12 between a closed and an open position. The above-mentioned assignment of the first or second rocker arm portion 1*a*, 1*b* to a cam 11 or a valve may however also be reversed.

FIG. 1 furthermore shows that the rocker arm shaft 2 in the present case is not designed as a continuous cylinder but has flattened regions 2*a* which serve for fixing a coupling device 4 for releasable, rotationally fixed connection of the first and second rocker arm portions 1*a*, 1*b*.

Here, the coupling device 4 is configured as a bearing block 4*b* which is guided on two guide pins 4*d*1, 4*d*2 and clamped against the first and second rocker arm portions 1*a*, 1*b* by means of a clamping device 4*e* in the form of two coil springs 4*e*1, 4*e*2. In the present embodiment, the coupling device 4 is here arranged above the rocker arm shaft 2 in the gravitational direction. Alternatively however, other positions of the coupling device 4 relative to the rocker arm shaft 2 are possible. This, the precise configuration of the bearing block 4*b* and the function of the coupling mechanism according to the invention are described in more detail in connection with the following figures.

FIG. 2 shows a diagrammatic, exploded depiction of a two-piece rocker arm 10 of the switchable actuation device 100 according to an embodiment of the invention. As mentioned above, the two-piece rocker arm 10 here has a first rocker arm portion 1*a* and a second rocker arm portion 1*b*. The two rocker arm portions 1*a* and 1*b* may here each be configured as a one-sided lever, i.e. one end region of each may be designed for pivotable mounting of the lever and another end region of each for force transmission. As shown in FIG. 2, a bearing sleeve 1*a*1—in the present case, in the form of a hollow cylinder—is attached to the first rocker arm portion 1*a*. If the bearing sleeve 1*a*1 and the first rocker arm portion 1*a* are here made from several pieces, the fixings—i.e. the preferably permanent, rotationally fixed interconnection—may be achieved for example by welding, soldering and/or press fitting. Alternatively, the bearing sleeve 1*a*1 and the first rocker arm portion 1*a* may also be formed as one piece, e.g. the bearing sleeve 1*a*1 is formed integrally on the first rocker arm portion 1*a*.

The second rocker arm portion 1*b* is pivotably mounted on the hollow cylindrical bearing sleeve 1*a*1. In other words, the bearing sleeve 1*a*1 attached to the first rocker arm portion 1*a* may thus serve as a plain bearing for the second rocker arm portion 1*b*. In order to fix the axial position of the second rocker arm portion 1*b* on the bearing sleeve 1*a*1, the bearing sleeve 1*a*1 may furthermore comprise a groove 1*a*2 running circumferentially, i.e. perpendicularly to the rocker arm shaft 2. A locking ring 5 may be inserted therein for securing the axial position of the second rocker arm portion 1*b*, wherein to reduce friction, also a thrust washer 6 may be arranged axially between the second rocker arm portion 1*b* and the locking ring 5. To reduce friction further, the two-piece rocker arm 10 may furthermore comprise a preferably hollow cylindrical plain bearing bush 7, by means of which the first rocker arm portion 1*a* and/or the bearing bush 1*a*1 are/is mounted on the rocker arm shaft 2. Preferably, the plain bearing bush 7 is here configured to surround the rocker arm shaft 2 concentrically, or to completely enclose this circumferentially. Instead of using a (optional) plain bearing bush 7, the first rocker arm portion 1*a* and/or the bearing bush 1*a*1 may also be mounted directly on the rocker arm shaft 2, wherein then preferably additionally a slip layer, e.g. $MoS_2$, may be applied to the rocker arm shaft 2.

For releasable, rotationally fixed connection of the first and second rocker arm portions 1*a* and 1*b*, the first rocker arm portion 1*a* comprises a first cutout 3*a* and the second rocker arm portion 1*b* comprises a second cutout 3*b*. In the present case, these take the form of a respective groove extending parallel to the rocker arm shaft 2 with trapezoid cross-section. The two cutouts 3*a* and 3*b* are arranged and dimensioned such that, as a whole, they may supplement each other to form a complete groove in which a locking element 4*a* (described in more detail below and preferably of complementary shape) may engage or be inserted in order to lock or couple the two rocker arm portions 1*a* and 1*b*. If this locking element 4*a* is in engagement with the first and second cutouts 3*a*, 3*b* (=locking position $S_a$), the two rocker arm portions 1*a* and 1*b* are connected rotationally fixedly by the locking element 4*a* which bridges the two cutouts 3*a*, 3*b*, so that movement can be transmitted between the camshaft 12 and the poppet valve. If however the locking element 4*a* is not in engagement with the first and second cutouts 3*a*, 4*b* (=release position $S_e$), the two rocker arm portions 1*a* and 1*b* are not coupled together for motion transmission, i.e. they are pivotable independently of each other, so that in this case no movement can be transmitted between the camshaft 12 and the poppet valve. In the present case, the locking element 4*a* engages in the first and second cutouts 3*a*, 3*b* "from above". Alternatively, by corresponding arrangement of the first and second cutouts 3*a*, 3*b* and the coupling device 4, an engagement "from below" or from any radial direction may be achieved.

FIG. 3 shows an exploded diagrammatic depiction of a coupling device 4 of the switchable actuation device 100 including a locking element 4*a*, in the present case formed as an insert wedge, according to one embodiment of the invention. The locking element 4*a*, which has its greatest extent along the rocker arm shaft 2, is formed complementary in shape to the first and second cutouts 3*a*, 3*b* (see FIG. 2). In this way, the locking element 4*a* may cooperate as optimally as possible with the first and second cutouts 3*a*, 3*b* in the form of a tongue-and-groove engagement, in order to releasably connect the two rocker arm portions 1*a* and 1*b* together rotationally fixedly.

To hold and guide the locking element 4*a* and in particular to switch between the locking position $S_a$ and the release position $S_e$ as reliably as possible, two pegs 4*a*1 and 4*a*2 are attached to the locking element 4*a*, by means of which the locking element 4*a* is mounted pivotably in a bearing block 4*b*. The bearing block 4*b* is here configured as a portal shape and comprises two bearing cheeks 4*b*1, 4*b*2 which are spaced apart in the axial direction and each comprise slots 4*b*3 (only one being shown) extending in the circumferential direction, in which the locking element 4*a* is guided by means of the pegs 4*a*1, 4*a*2. This slot guidance allows a restricted movement of the locking element 4*a* in the circumferential direction, which facilitates the insertion of the locking element 4*a* in the first and second cutouts 3*a*, 3*b* and hence the change between the locking position $S_a$ and the release position $S_e$. In order to additionally fix the locking element 4*a* in the radial direction, the bearing block 4*b* furthermore comprises a guide roller 4*c* mounted rotatably in the axial direction and resting on the locking element 4*a*. Preferably, the rotatably mounted guide roller 4*c* may here roll on an outer face of the locking element 4*a*, whereby advantageously an optimal radial force transmission for securing the locking element 4*a* can be achieved at any time or in any pivot position.

Furthermore, the present embodiment of the bearing block 4*b* comprises two guide eyes 4*f*1 and 4*f*2, by means of which the bearing block 4*b* is guided, preferably for movement in the radial direction, on two slide pins 4*d*1 and 4*d*2 (see FIG. 1). It is particularly advantageous here if the coupling device furthermore comprises a clamping device, by means of which the bearing block 4*b* can be clamped in the radial direction against the first and second cutouts 3*a*, 3*b*. As shown in FIG. 1, this may take the form of two coil springs 4*e*1, 4*e*2 surrounding the slide pins 4*d*1, 4*s*2, wherein the coil springs 4*e*1, 4*e*2 each rest with one end on the respective guide eye 4*f*1, 4*f*2 and with the opposite end on a stop of the respective slide pin 4*d*1, 4*d*2.

FIG. 4 shows a diagrammatic side view of the switchable actuation device 100 according to FIG. 1, respectively in a locking position $S_a$ (top) and in a release position $S_e$ (bottom). Here, in the locking position $S_a$ shown at the top, the locking element 4*a* is almost completely inserted in the first and second cutouts 3*a*, 3*b*, whereby the first and second rocker arm portions 1*a* and 1*b* are coupled together for motion transmission. In the release position $S_e$ shown at the bottom, the locking element 4*a* is not in contact with the first and/or second cutout 3*a*, 3*b*, whereby the first and second rocker arm portions 1*a*, 1*b* are movable independently of each other. The change between these two positions takes place by movement of the locking element 4*a* in a plane perpendicular to the rocker arm shaft 2, preferably by radial movement of the locking element 4*a*. In the embodiment shown here, for this the bearing block 4*b* guided on the slide pins 4*d*1, 4*d*2 may be raised or lowered radially relative to the rocker arm shaft 2 by means of the switch device 13. The switch device 13 is here designed in the form of an electromagnet which cooperates magnetically with a permanent magnet material attached to the bearing block 4*b*. Also or alternatively, the switch device 13 may also comprise a piston-cylinder arrangement attached to the bearing block 4*b*, wherein the cylinder is loaded with a hydraulic medium and/or compressed air for switching the locking element 4*a*.

FIG. 5 shows an enlarged detail view of the region of the first cutout 3*a* in the release position $S_e$ shown in FIG. 4. Here, the shape or cross-section of the cutout 3*a* and the locking element 4*a* can be seen more clearly. In the present case, the first and second cutouts 3*a*, 3*b* are each formed as a trapezoid groove extending parallel to the rocker arm shaft 2. In other words, the first and second cutouts 3*a*, 3*b* have a groove cross-section which tapers towards the rocker arm shaft 2. This is delimited towards the rocker arm shaft 2 by a groove base and at the side by two groove flanks, wherein these are sloped by a slope angle $\alpha$ in comparison with an ideal rectangular cross-section. This slope facilitates insertion of the complementarily shaped locking element 4*a* in the first and second cutouts 3*a*, 3*b*. Here, the slope angle $\alpha$ of the groove flanks is however smaller than the self-locking angle $\alpha_h$ of the corresponding material pairing of the first lever arm portion and locking element, and/or of the second lever arm portion and locking element (11.4° in this example), so that the locking element 4*a* is clamped in self-locking fashion in the locking position $S_a$. In this way, advantageously, a reliable fixing of the locking element 4*a* in the circumferential direction may be achieved.

FIG. 6 shows a motor vehicle 30 comprising an internal combustion engine 20 with a switchable actuation device 100 for a poppet valve according to one embodiment of the invention. In the present case, the motor vehicle 30 is a utility vehicle in the form of a truck. Alternatively however, the motor vehicle 30 may also be a bus and/or a semitrailer. Advantageously, by means of the switchable actuation device 100 according to the invention in the motor vehicle 30 depicted diagrammatically, a gas exchange of individual poppet valves of the internal combustion engine 20 may be deactivated in targeted fashion—preferably in low load operation—and thereby as a whole the fuel consumption may be lowered.

Although the invention has been described with reference to specific exemplary embodiments, it is evident to the person skilled in the art that various changes may be made and equivalents used as substitutes without leaving the scope of the invention. Accordingly, the invention is not restricted by the exemplary embodiments disclosed but comprises all exemplary embodiments which fall within the scope of the appended patent claims. In particular, the invention also claims protection for the subject and features of the sub-claims independently of the claims to which reference is made.

LIST OF REFERENCE SIGNS

1*a* First rocker arm portion
1*a*1 Bearing sleeve
1*a*2 Groove
1*a*3 Roller
1*b* Second rocker arm portion
2 Rocker arm shaft
2*a* Flattened portion of rocker arm shaft
3*a* First cutout
3*b* Second cutout
4 Coupling device
4*a* Locking element
4*a*1, 4*a*2 Pegs
4*b* Bearing block
4*b*1, 4*b*2 Bearing cheeks
4*b*3 Slot
4*c* Guide roller
4*d*1, 4*d*2 Slide pin
4*e* Clamping device
4*e*1, 4*e*2 Coil springs
4*f*1, 4*f*2 Guide eyes
5 Locking ring
6 Thrust washer
7 Plain bearing bush
10 Two-piece rocker arm
11 Cam
12 Camshaft
13 Switch device
20 Internal combustion engine
30 Motor vehicle
100 Actuation device
$S_a$ Locking position
$S_e$ Release position
$\alpha$ Slope angle
$\alpha_h$ Self-locking angle

The invention claimed is:

1. A switchable actuation device for a poppet valve in an internal combustion engine which is movable indirectly and periodically via a cam of a camshaft between a closed and an open position, comprising:

a) a two-piece rocker arm for actuating the poppet valve, comprising:

$a_1$) a first rocker arm portion which is mounted pivotably about a rocker arm shaft and on which a bearing sleeve is attached concentrically with the rocker arm shaft; and $a_2$) a second rocker arm portion which is mounted pivotably on the bearing sleeve;

wherein the first rocker arm portion comprises a first cutout, and the second rocker arm portion comprises a second cutout; and b) a coupling device for releasable, rotationally fixed connection of the first and second rocker arm portions, comprising a locking element which may be brought optionally into and out of engagement with the first and second cutouts, wherein actuation of the poppet valve is interrupted if the locking element is not in engagement with the first or second cutout.

2. The actuation device as claimed in claim 1, wherein the bearing sleeve a) is formed integrally on the first rocker arm portion; and/or b) surrounds the rocker arm shaft concentrically; and/or c) comprises a groove in which a locking ring is inserted for securing the axial position of the second rocker arm portion.

3. The actuation device as claimed in claim 1, wherein by a movement perpendicularly to the rocker arm shaft, the locking element may be brought optionally into a) a release position $S_e$, in which the locking element is not in engagement with the first and second cutouts, or b) a locking position $S_a$, in which the locking element is in engagement with the first and second cutouts.

4. The actuation device as claimed in claim 1, wherein a) the first and second cutouts are each formed as a groove extending parallel to the rocker arm shaft, with a groove cross-section which tapers towards the rocker arm shaft; and b) the locking element is formed wedge-shaped and/or frustoconical and/or at least in portions complementary in shape to the first and/or second cutout.

5. The actuation device as claimed in claim 4, wherein each of the groove cross-sections is configured to clamp the locking element in self-locking fashion in the circumferential direction on engagement of the locking element in the first and second cutouts.

6. The actuation device as claimed in claim 4, wherein each of the groove cross-sections is delimited towards the rocker arm shaft by a groove base and at the sides by two groove flanks, wherein a slope angle $\alpha$ of the groove flanks is smaller than a self-locking angle $\alpha_h$ of the material pairing of the first rocker arm portion and the locking element and/or of the second rocker arm portion and the locking element.

7. The actuation device as claimed in claim 1, wherein the locking element a) has its greatest extent along the rocker arm shaft; and/or b) extends parallel to the rocker arm shaft; and/or c) is movable only perpendicularly to the rocker arm shaft.

8. The actuation device as claimed in claim 1, wherein the coupling device comprises a bearing block for axially fixing the locking element, wherein the bearing block has two bearing cheeks which are spaced apart in the axial direction and on which the locking element is pivotably mounted by means of two pegs attached to the locking element.

9. The actuation device as claimed in claim 8, wherein the pegs of the locking element are each guided in a slot of the bearing cheeks of the bearing block which extends in the circumferential direction.

10. The actuation device as claimed in claim 8, wherein the bearing block comprises a guide roller which is mounted so as to be rotatable in the axial direction and which rests on the locking element in the radial direction for radially fixing the locking element.

11. The actuation device as claimed in claim 8, wherein the coupling device comprises at least one slide pin which is arranged on the rocker arm shaft, or a slide rail which is arranged on the rocker arm shaft, and on which the bearing block is arranged so as to be displaceable radially relative to the rocker arm shaft.

12. The actuation device as claimed in claim 8, wherein the coupling device comprises a clamping device, by means of which the bearing block can be clamped in the radial direction against the first and second cutouts.

13. The actuation device as claimed in claim 1, wherein an electromagnetic and/or pneumatic and/or hydraulic switch device, by means of which the locking element can be actuated so as to be brought optionally into and out of engagement with the first and second cutouts.

14. The actuation device as claimed in claim 1, wherein the poppet valve is a gas exchange valve.

15. An internal combustion engine comprising a poppet valve with a switchable actuation device as claimed in claim 1.

16. The internal combustion engine of claim 15, wherein the internal combustion engine is a diesel internal combustion engine.

17. A motor vehicle comprising an internal combustion engine as claimed in claim claim 15.

18. The motor vehicle of claim 17, wherein the motor vehicle is a utility vehicle.

* * * * *